US010724231B1

(12) United States Patent
Treville et al.

(10) Patent No.: US 10,724,231 B1
(45) Date of Patent: Jul. 28, 2020

(54) METHODS AND CONFIGURATIONS OF AN AIRTIGHT BUILDING

(71) Applicant: STOREX CA CONTROLLED ATMOSPHERE INC, Montreal (CA)

(72) Inventors: Louis-Christophe Treville, Montreal (CA); Philip Treville, Montreal (CA)

( * ) Notice: Subject to any disclaimer, the term of this patent is extended or adjusted under 35 U.S.C. 154(b) by 0 days.

(21) Appl. No.: 16/428,945

(22) Filed: May 31, 2019

(51) Int. Cl.

| | |
|---|---|
| ***E04B 1/80*** | (2006.01) |
| ***E04B 1/76*** | (2006.01) |
| ***E04B 1/61*** | (2006.01) |
| ***E04F 19/02*** | (2006.01) |
| ***E04B 1/08*** | (2006.01) |
| ***E04B 1/18*** | (2006.01) |
| ***E04B 1/41*** | (2006.01) |
| *E04B 1/38* | (2006.01) |

(52) U.S. Cl.
CPC ..... *E04B 1/80* (2013.01); *E04B 1/08* (2013.01); *E04B 1/185* (2013.01); *E04B 1/40* (2013.01); *E04B 1/61* (2013.01); *E04B 1/76* (2013.01); *E04F 19/026* (2013.01); *E04B 2001/405* (2013.01); *E04B 2001/6195* (2013.01)

(58) Field of Classification Search
CPC ..... E04B 1/80; E04B 1/76; E04B 1/40; E04B 1/08; E04B 1/62; E04B 1/185; E04B 2001/405; E04B 2001/6195; E04F 19/026
USPC ..... 52/250
See application file for complete search history.

(56) References Cited

U.S. PATENT DOCUMENTS

| | | | | |
|---|---|---|---|---|
| 2,186,310 A * | 1/1940 | Von Hoefen | E04B 1/08 | 52/236.7 |
| 2,212,982 A * | 8/1940 | Drain, Jr. | E04B 1/24 | 52/407.1 |
| 3,537,379 A * | 11/1970 | Kaneko | F24F 13/16 | 454/275 |
| 4,632,604 A * | 12/1986 | McKelvy | E02B 17/028 | 165/45 |
| 8,938,927 B1 * | 1/2015 | Bragg | E04F 13/0803 | 52/483.1 |
| 2012/0240512 A1 * | 9/2012 | Ting | E04B 1/14 | 52/745.13 |

* cited by examiner

*Primary Examiner* — Jeanette E Chapman
(74) *Attorney, Agent, or Firm* — Gleam Law, PLLC; Neil Juneja

(57) ABSTRACT

Generally described, an airtight building, or Construx Airtight Hybrid Building (CAHYB), includes an internal structural support, for example, a core anchored to a concrete foundation wall or a concrete slab, to form the structural frame of the airtight building, and a plurality of insulated metal panels to provide atmospheric stability such that the atmosphere within the airtight building may be controlled. In some configurations, the insulated metal panels are used as the outside perimeter wall. Structural caulking is applied to the interface between the core and the plurality of insulated metal panels to form a building with a degree of airtightness.

22 Claims, 4 Drawing Sheets

METHODS AND CONFIGURATIONS OF AN AIRTIGHT BUILDING

BACKGROUND

Specifications of certain buildings require a degree of airtightness for creating atmosphere-controlled environments. The level of airtightness is dictated by the designated commercial application, required tolerances, and certification level. Some examples of commercial uses for an airtight building include storage of fruit or vegetables, indoor cultivation (greenhouses), simulation of low or high altitude conditions, fire prevention, and pest control, among others.

Existing methods for constructing an airtight building generally involve two distinct construction phases. Phase one includes constructing a building structure in a traditional manner, and phase two includes modifying the conventional structure to achieve the desired level of airtightness specification. Modifications performed during the airtight phase may include installing specialized panels, drilling openings for air conditioning and various atmosphere control equipment, and sealing gaps with caulking compound and/or expanding/non-expanding foams.

Conventional airtight building methods have various disadvantages, including the costs and extended timeline incurred by having separate construction phases. In addition, airtightness may be prone to compromise due to normal expansion and/or contraction of the building materials and/or the building structure, such as through ground shift, wind, snow, or other natural forces. In some examples, gaps sealed with caulking compound may begin to re-split, fastener and pipe openings made through insulating panels can erode and leak, and/or insulating panels may become detached from the building structure and other components. Similarly, airtightness may be compromised when building walls sustain impact from equipment, for example, a forklift.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a building having a degree of airtightness is provided. The building generally includes a concrete foundation slab; a first column and a second column extending vertically from the concrete foundation slab; a plurality of insulated metal panels coupled to the first and second columns, by the use of girts designed for airtight applications, the plurality of insulated metal panels may form a wall of the building; and a seal disposed at the interface of the plurality of insulated metal panels and the first and second columns.

In accordance with another embodiment of the present disclosure, an atmospherically controlled building is provided. The building generally includes a concrete foundation wall forming a perimeter of the building; a plurality of columns extending vertically from the concrete foundation wall; a plurality of insulated metal panels coupled to the columns, by the use of girts designed for airtight applications, and extending from the concrete foundation wall, the plurality of insulated metal panels forming a perimeter wall of the building; a concrete foundation slab extending between the plurality of columns; and a seal disposed at the interface of the plurality of insulated metal panels and the columns, and the interface of the plurality of insulated metal panels and the concrete foundation slab.

In accordance with another embodiment of the present disclosure, a method of constructing a building with a degree of airtightness is provided. The method generally includes pouring a concrete foundation wall to form a building perimeter; anchoring a plurality of columns to the concrete foundation wall such that the plurality of columns extend vertically from the concrete foundation wall around the building perimeter; coupling a plurality of insulated metal panels to the columns, by the use of girts designed for airtight applications, to form a perimeter wall of the building; pouring a concrete foundation slab to extend between the plurality of columns; coupling a plurality of beams to the distal ends of the plurality of columns, the beams arranged horizontally; coupling a plurality of insulated metal panels to the beams to form a roof of the building; and applying a seal at the interface of the plurality of insulated metal panels forming the perimeter wall and the columns, the interface of the plurality of insulated metal panels forming the perimeter wall and the concrete foundation slab, the interface of the plurality of insulated metal panels forming the roof and the plurality of beams, and the interface of the plurality of insulated metal panels forming the perimeter wall and the plurality of insulated metal panels forming the roof.

In accordance with any of the embodiments described herein, the building may further include a plurality of beams extending between the distal ends of the columns, a plurality of trusses spanning the perimeter of the building, and a plurality of insulated metal panels coupled to the plurality of beams and trusses, by the use of girts designed for airtight applications, and forming a roof of the building.

In accordance with any of the embodiments described herein, the plurality of insulated metal panels forming the wall and the plurality of insulated metal panels forming the roof may be coupled with an L-shaped bracket at the intersection of the wall and the roof.

In accordance with any of the embodiments described herein, the building may further include a guard portion extending horizontally between the first and second columns and configured to deflect impacts away from the plurality of insulated metal panels.

In accordance with any of the embodiments described herein, the seal may include a poly-urethane caulking.

In accordance with any of the embodiments described herein, the plurality of insulated metal panels forming the wall may be coupled to the exterior of the plurality of columns, by the use of girts designed for airtight applications.

In accordance with any of the embodiments described herein, the plurality of insulated metal panels forming the wall may be coupled to the concrete foundation wall using a custom U-channel bracket.

In accordance with any of the embodiments described herein, a primer, paint, and a fleece may be applied to the plurality of insulated metal panels.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The following description provides several examples that relate to configurations of an airtight building and the methods of manufacturing airtight buildings according to aspects of the present disclosure. In the following description, the airtight building may be referred to as a Construx Airtight Hybrid Building (CAHYB). An airtight building constructed using aspects of the present disclosure will exhibit a degree of airtightness depending on the specification required. The use of the term "airtight" herein is intended to apply to any degree of gas impervious surface, and is not limited to air alone. In this regard, the present disclosure applies to structures intended to limit the travel of gases with a smaller molecular structure than air, requiring a higher degree of airtightness.

Figure 1:
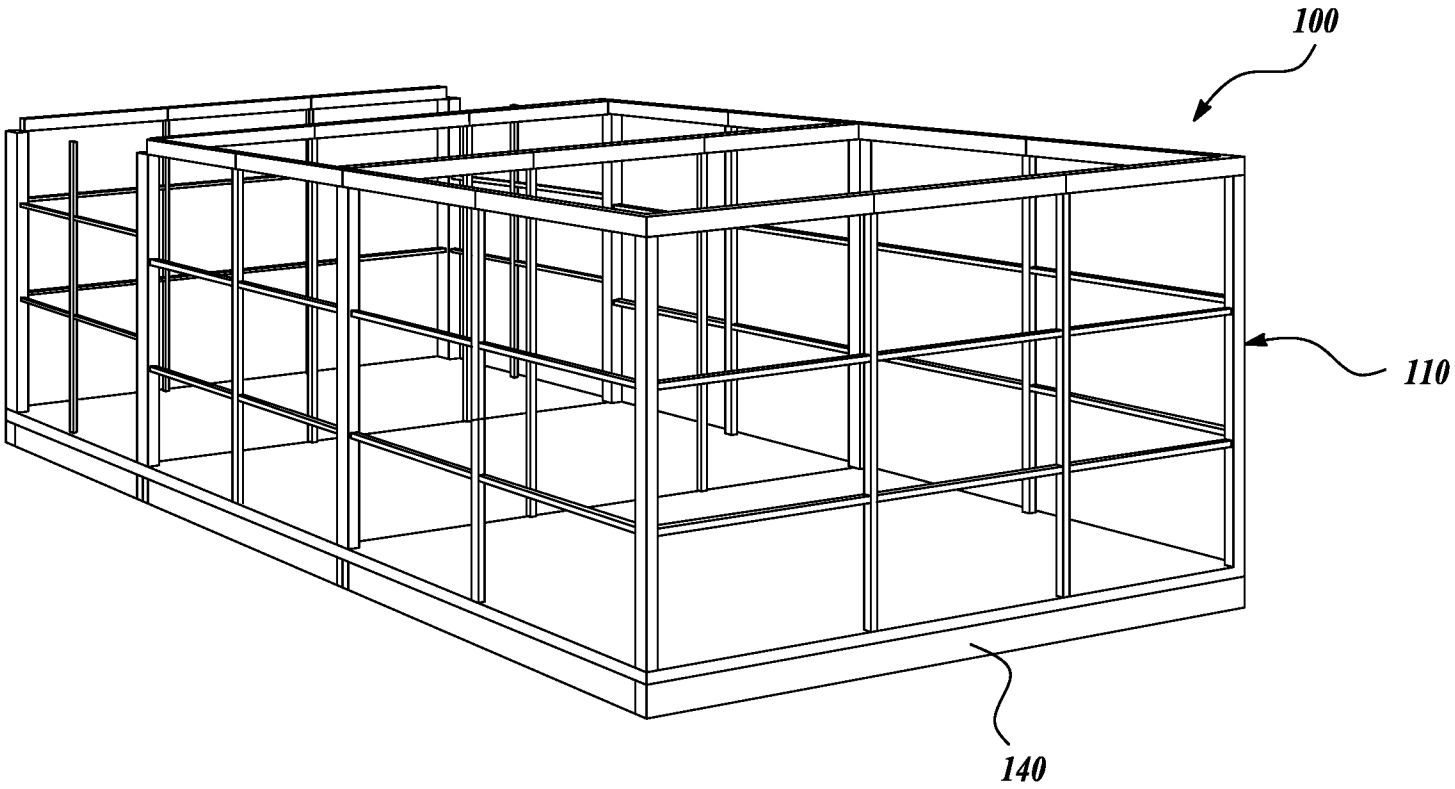
FIG. 1 includes one embodiment of a core of an airtight building in accordance with aspects of the present disclosure, showing a concrete slab and core structure of the airtight building.

Generally described, as shown in FIG. 1, an airtight building 100, or CAHYB, includes an internal structural support, for example, a core 110 anchored to an inner concrete foundation wall 148 (see FIG. 4), an outer concrete foundation wall 140, or a concrete slab 142, to form the structural frame of the airtight building 100, and insulated metal panels 120 (see FIG. 2) to provide atmospheric stability such that the atmosphere within the airtight building 100 may be controlled. In other embodiments, the inner concrete foundation wall 148 and the outer concrete foundation wall 140 are combined to form a single concrete foundation wall (not shown).

Figure 4:
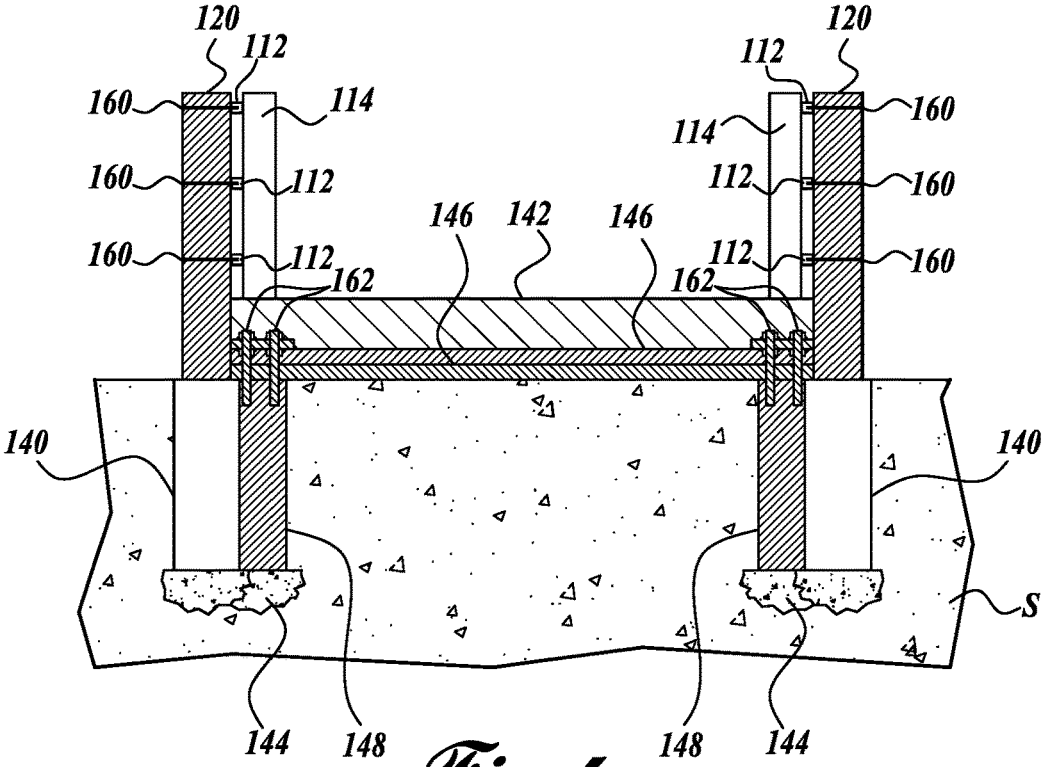
FIG. 4 is a cross-sectional view of another embodiment of an airtight building in accordance with aspects of the present disclosure, showing an exemplary concrete foundation configuration.

In some embodiments, the insulated metal panels 120 are used as the outside perimeter wall, as shown in FIG. 4, such that the insulated metal panels 120 are exposed to weather elements. In other embodiments, the insulated metal panels 120 are suitable for use as internal dividing walls within the airtight building 100. In embodiments where the insulated metal panels 120 are positioned as the outside perimeter wall, the core 110 is suitably positioned interior to the insulated metal panels 120 (see, e.g., FIGS. 4 and 5). In other embodiments, the core 110 is positioned exterior to the insulated metal panels 120, or on either side of the insulated metal panels 120. In a further embodiment, the core 110 is positioned between an exterior and interior layer of insulated metal panels 120. In a further embodiment, the core 110 is positioned between an exterior layer and interior layer (not shown) of the insulated metal panels 120. In a further embodiment, the core 110 is incorporated into the insulated metal panels 120 to form a structural insulated metal panel.

Figure 2:
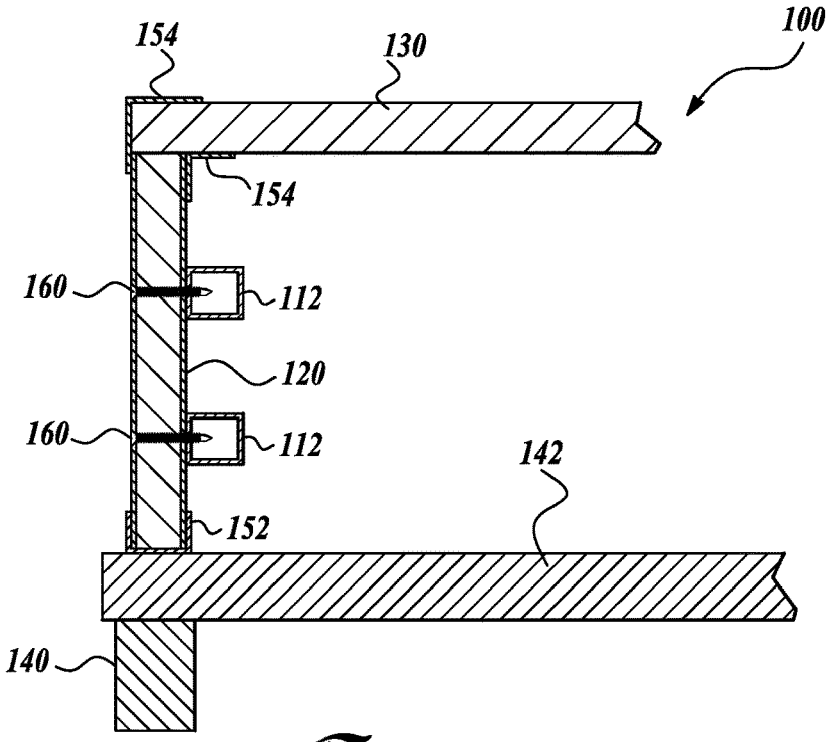
FIG. 2 is a cross-sectional view of the airtight building of FIG. 1, showing the concrete slab, core, and insulating panels.
Figure 3:
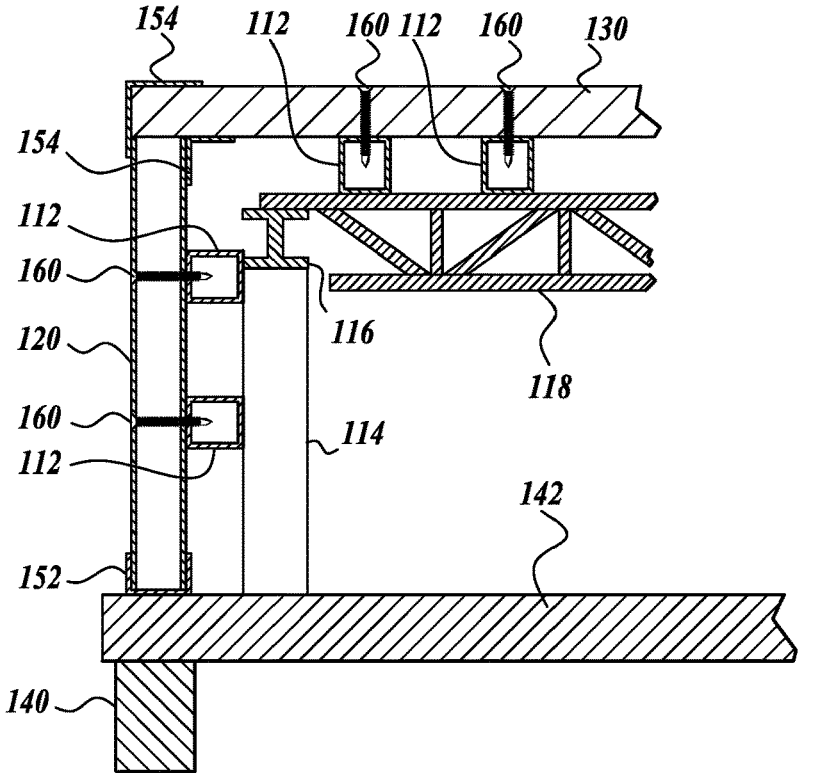
FIG. 3 is a cross-sectional view of the airtight building of FIG. 1, showing the concrete slab, core, insulating panels, and interior structure.

In the present disclosure, the core 110 is configured to sustain wind load, snow load, rain load, etc., according to local structural requirements. Turning to FIGS. 2 and 3, in some embodiments, the core 110 includes a guard portion 112, a vertical column 114, a beam 116, and a truss 118, as will be explained in greater detail below. The guard portion 112 is positioned to couple to the insulated metal panels 120 and 130, provide stability for the vertical column 114 or truss 118, and/or protect the insulating metal panels 120 and 130 from damage caused by moving objects inside the room during operation. In other aspects, the guard portion 112 provides structural support for hanging refrigeration, heating, air handler, lighting, and/or other equipment inside the rooms of the airtight building 100. In some embodiments, the guard portion 112 is designed for airtight applications.

Aspects of the present disclosure combine the conventional two-phase shell building with a separate internal insulated airtight structure into a single airtight hybrid building 100, including structure capable of modular configuration to achieve specified insulation values, for example, ranging from R20 to R48, among other insulation values. Certain advantages of the airtight building of the present disclosure over conventional airtight buildings include lower construction costs, shortened construction duration, high insulation capacity, lower operating costs for air conditioning and atmosphere control, fewer thermal and air leaks, etc. In some embodiments, a roof is constructed using roof insulating metal panels 130. In these embodiments of the airtight building 100, the roof is suitably configured for installation of one or more solar panels.

Still referring to FIGS. 2 and 3, the core 110 of the airtight building 100 will now be explained in greater detail. In some embodiments, the core 110 comprises steel, aluminum, wood, fiberglass, composite, or a combination thereof. In other embodiments, the core 110 comprises any suitable structural material. The core 110 includes one or more of the vertical columns 114 to provide structural support to various components of the airtight building 100. In this regard, the spacing of the vertical columns 114, the beams 116, and the trusses 118 will vary depending on the size of the building, the application, local weather, and/or building code requirements. In some embodiments of the airtight building 100, each room suitably has a separate core 110 such that no penetration exists through the walls of the airtight room, which improves airtightness of the airtight building 100.

In some embodiments, the interior or exterior sides of the insulated metal panels 120 and 130 are finished in different colors, claddings, or other protective or decorative covering (e.g., brushed aluminum, metallic steel color plates, imitation brick, granite, etc.). In other embodiments, aspects of the core 110 are built to provide sufficient draining of any water or snow accumulation on the roof 130, such as by adding a slope or other drainage mechanism.

In certain embodiments, the airtight building 100 includes a hallway (not shown) positioned between two rows of rooms, or in front of a row of rooms. In other embodiments, the airtight building 100 includes a mezzanine (not shown) attached as an external room to the airtight building 100. In these examples, the hallway or mezzanine may be used as a centrally located equipment room for air conditioning or atmosphere control equipment. Configurations using the hallway or mezzanine reduce installation, labor, and material costs, and increase equipment efficiency as a result of a reduction of energy loss in transition of a thermal medium (e.g., air, refrigerant, gases, or fluids) to one or more atmospherically controlled rooms.

Construction Method

Figure 6:
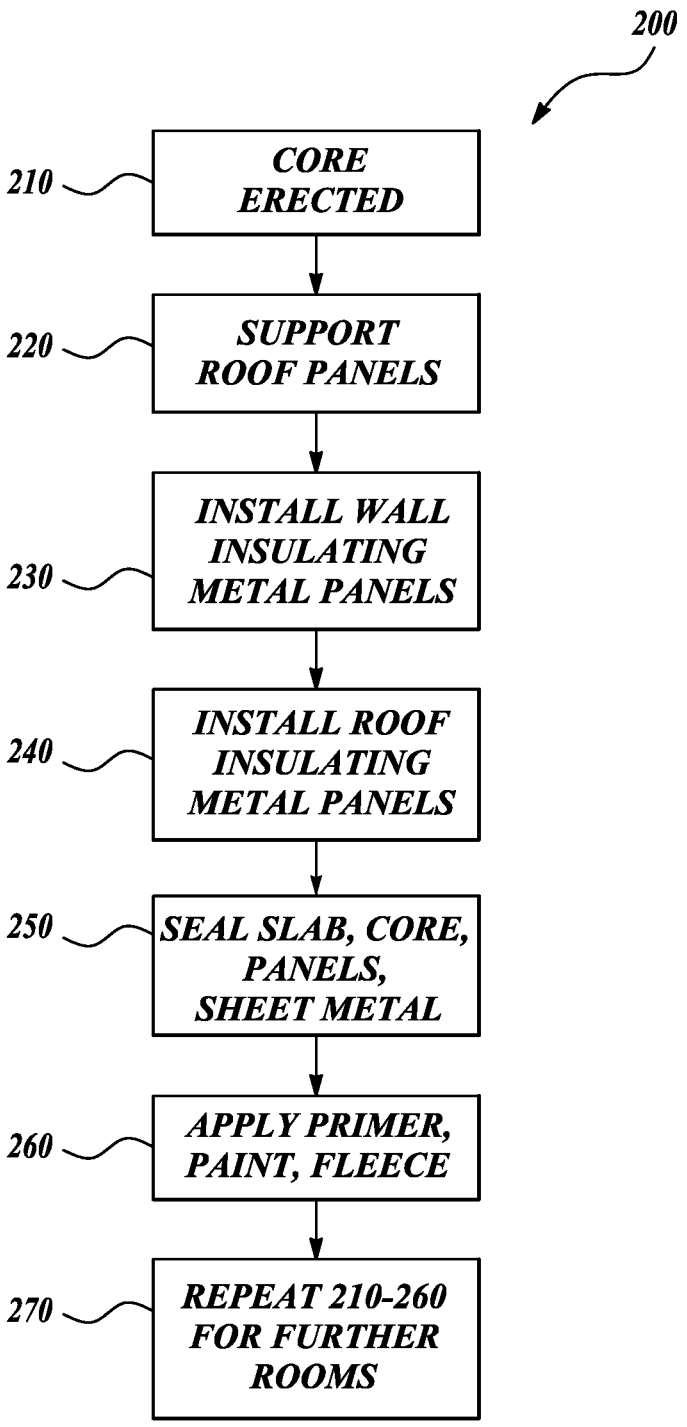
FIG. 6 is a flow diagram of one embodiment of a method of construction of an airtight building in accordance with aspects of the present disclosure.

Turning to FIG. 6, one embodiment of a construction method 200 of the airtight building 100 will now be described in detail. In the following embodiments, certain aspects of the present disclosure are described in view of methods for construction of the airtight building 100; however, other methods of construction or order of operations are within the scope of the present disclosure.

Figure 5:
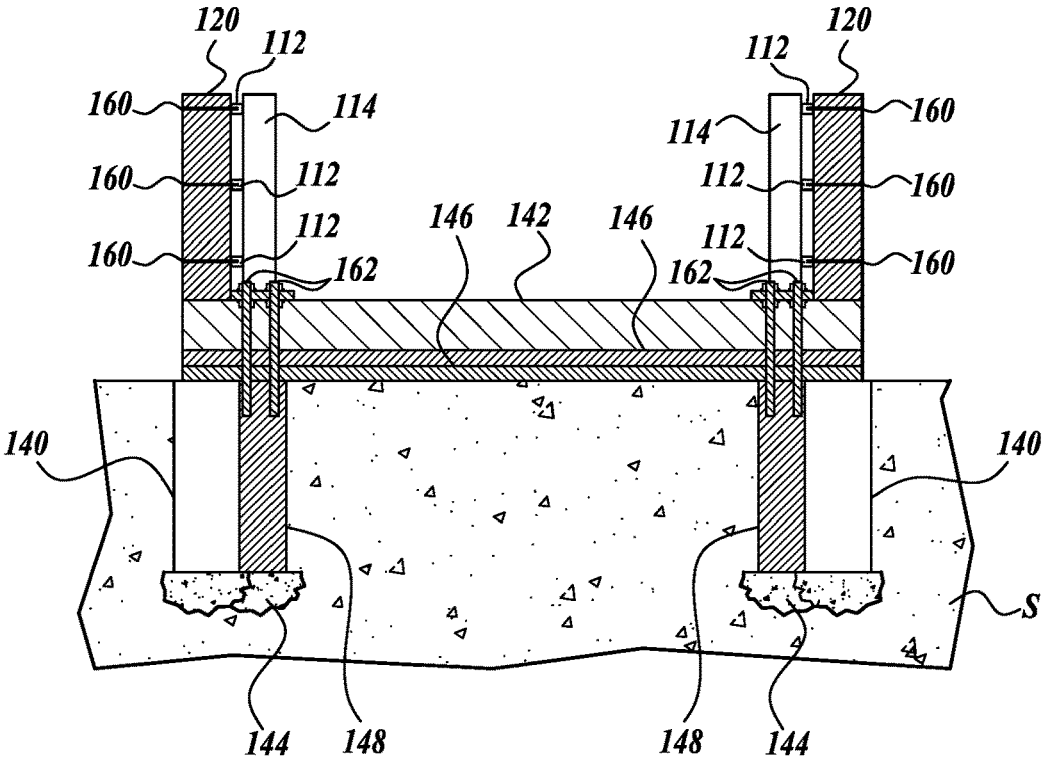
FIG. 5 is a cross-sectional view of another embodiment of an airtight building in accordance with aspects of the present disclosure, showing an exemplary concrete foundation configuration.

In a first stage, in block 210, the core 110 is erected as a frame, (containing one or more guard portions 112, vertical columns 114, beams 116, and trusses 118), for one or multiple rooms within the airtight building 100. Turning briefly to FIG. 4, in some embodiments, the vertical columns 114 of the core 110 are suitably anchored by anchors 162 to the inner concrete foundation wall 148, which is supported by concrete foundation footers 144 located under the position of the vertical columns 114. In other embodiments, as shown in FIG. 5, the vertical columns 114 of the core 110 are suitably anchored by the anchors 162 to the concrete foundation slab 142, which is supported by one or more of the outer concrete foundation wall 140, the inner concrete foundation wall 148, which are supported by one or more concrete foundation footers 144 located under the position of the vertical columns 114.

It should be appreciated that the outer concrete foundation wall 140 and the inner concrete foundation wall 148 may be formed as part of the same foundation wall, where the inner concrete foundation wall 148 is a sub out. In this regard, while the outer concrete foundation wall 140 may have a suitable thickness (e.g., 8 inches) to support the insulated metal panels at the locations where the vertical columns 114 are placed, the thickness of the outer concrete foundation wall 140 will increase (e.g., to 20 inches) to accommodate the anchor plate of the vertical column 114. In other embodiments, only foundations for the columns may be poured to support the vertical columns 114 and the insulated metal panels may suitably be positioned directly onto the compacted sub floor of excavated soil S that supports the concrete foundation slab 142.

To complete the core 110, one or more beams 116 connect the vertical columns 114 together around the perimeter of the core 110. In some embodiments, a single concrete foundation wall is used to support the core 110 of the airtight building 100.

Next, in block 220, beams 116 and open webbed joist trusses 118, (e.g., manufactured from metal or wood, see FIG. 3), are used to support the roof insulating metal panels 130. In these embodiments, the guard portions 112 are positioned between the insulating metal panels 130 and the trusses 118 (see FIG. 3). In some embodiments, wind bracing is applied to accommodate certain engineering requirements.

Next, in block 230, the (wall) insulating metal panels 120 are positioned extending upward from the finished concrete foundation slab 142 and installed to at least the guard portions 112. In some embodiments, the insulating metal panels 120 are placed inside a U-channel bracket 152 (see FIG. 2). In other embodiments, the insulating metal panels 120 are placed directly on the outer concrete foundation wall 140 (such that the finished slab 142 is above the base of the insulating metal panels 120, as shown in FIG. 4) and are fastened to the core 110 using fasteners 160.

Next, in block 240, a roof-type insulating metal panel 130 is installed. Roof insulating metal panels 130 are hoisted on to the core 110 and are supported, fastened, and sealed to the vertical columns 114 and/or beams 116 of the core 110 and to the insulating metal panels 120. In some embodiments, L-shaped bracket 154 is applied to cover the roof insulating metal panel 130 to the core 110 or the insulating metal panel 120 connections on the outside for moisture protection and aesthetic purposes. In some embodiments, the roof insulating metal panels 130 include an interlocking system with a tongue and groove connection for airtightness, and a standing seam that allows them to interlock, seal and fold over each roof insulating metal panel 130 for weatherproofing and forming a roof membrane. Each double groove receives caulk prior to interlocking it with a previously installed roof insulating metal panel 130. A tool may be used to achieve watertight interlocking, such that there is no need for an additional membrane to make the roof insulating metal panels 130 weatherproof.

Next, in block 250, certain components are sealed with the insulating metal panels 120 and 130, including the concrete foundation slab 142, the core 110, the sheet metal brackets (U-channel bracket 152, L-shaped bracket 154), and other components. The sealing step 240 may be completed on the inside of each room of the airtight building 100 with a poly-urethane caulking or other suitable material. The poly-urethane caulking is configured to cure and become a structural component of the airtight building 100, remaining flexible to promote airtightness, as opposed to butyl caulking, which does not cure to provide any structural support.

Applying the sealing step of block 250 includes using a poly-urethane caulking on all seams between each insulating metal panel 120 and 130, and caulking and fastening a sealing object (such as the sheet metal L-shaped bracket 154 shown in FIG. 3, a steel vertical column 114, steel girth, purling, or wood beam, etc.) to all wall-to-wall corners and roof-to-wall corners. In some embodiments, caulking is then applied to all floor-to-wall corners. If a U-channel bracket 152 is used with the insulating metal panels 120, the U-channel bracket 152 is sealed with the caulking and anchored using an appropriate fastener to the finished concrete foundation slab 142 and receives caulking on both the inside and outside of the rooms in the corner between the concrete slab 142 and the U-channel bracket 152 to seal gaps around the U-channel bracket 152. In these embodiments, the interior of the U-channel bracket 152 receives caulk on both sides prior to inserting the insulating metal panels 120, and the insulating metal panels 120 are inserted into the U-channel bracket 152 and temporarily fastened through the standing sides of the U-channel bracket 152 using the fasteners 160, such as screws. If a U-channel bracket 152 is omitted, the insulating metal panels 120 are placed directly on the concrete foundation slab 142, footer 144, or compacted subfloor of excavated soil S and sealed to the concrete component by applying caulking in the corner between concrete slab and insulating metal panels 120 and 130.

In some embodiments, hollow core steel tubes may form part of the core 110. The hollow core steel tubes are welded shut to close out each end of the hollow core steel tube, such that the cores are airtight. In these embodiments, the airtight hollow core steel tubes creates an environment where insulated metal panels 120 and 130 can be fastened to the hollow core 110 without compromising the airtight integrity of the room itself, as the air inside the hollow core steel is separate from the air inside the room.

The insulating metal panels 120 and 130 are individually set in place and fastened with the fasteners 160 in the designated areas to the core 110 to form a wall or roof, in addition to the fasteners 160, some embodiments may also utilize a clip, bracket, or washer system with two fasteners 160 per anchor point (not shown). In some embodiments, each insulating metal panel 120 and 130 interlocks with the previous insulating metal panel 120 and 130 through a double tongue and groove connection (not shown). Each double groove receives caulk prior to interlocking it with a previously installed insulating metal panel 120 and 130. In other embodiments, any suitable coupling between the insulating metal panels 120 and 130 is used. During installation, the insulating metal panels 120 and 130 are interlocked and fastened to the core 110 to transfer the force of wind load and other weather effects to the core 110.

Next, in block 260, a primer, paint, and a fleece are applied. The combination of components results in additional levels of airtightness protection. In some embodiments, the primer is a Storefill-Primer and allowed to dry. Next, the first layer of paint is a Storefill-Paint. While the paint is wet, a Storefill-Fleece is applied. The fleece is then saturated with paint, allowed to dry, and a final layer of Storefill-Paint gets applied over the fleece. In other embodiments, the fleece is omitted.

Next, in block 270, the core 110, insulating metal panels 120, and roof insulating metal panels 130 are installed on further rooms, hallways, or mezzanines. In some embodiments, airtight doors (not shown) are mounted on the insulating metal panels 120 to create a controlled seal to the entryway of each room. After such doors are installed, the caulking and painting steps of blocks 250 and 260 are again performed.

The Concrete Foundation

The following concrete foundation methods contribute to the airtightness and insulation value of each individual room. In some embodiments, as shown in FIG. 4, the concrete foundation slab 142 is isolated for each room within the airtight building 100. In these embodiments, the core 110 and insulating metal panels 120 are erected from the inner concrete foundation wall 148 or the outer concrete foundation wall 140. One or more slots may be formed in the excavated soil S for the foundation in which concrete foundation footers 144 are poured. Next, a casting is made on top of footers (not shown) and the rebar reinforced concrete foundation walls 140 and 148 are poured in the casting. As described above, in some embodiments, only a single concrete foundation wall or more than two concrete foundation walls are within the scope of the present disclosure. During the process of forming the inner and outer concrete foundation walls 148 and 140, the anchors 162 for the columns 114 of the core 110 are positioned in the concrete. In these embodiments, the core 110 and insulating metal panels 120 are assembled prior to pouring the concrete foundation slab 142.

In some embodiments, the soil S between the inner and outer foundation walls 148 and 140 is excavated and compacted to the top of the inner and outer foundation walls 148 and 140. Next, one or more layers of insulation 146 are placed over the soil S (see FIG. 4) against the insulating metal panels 120 and a vapor barrier (not shown) is placed over the insulation that wraps upward against the insulating metal panels 120 on all sides. In these embodiments, the concrete foundation slab 142 is then poured over the vapor barrier and the insulation 146. In some embodiments, the concrete foundation slab 142 is between about 6 inches and 8 inches thick and reinforced with rebar and/or fibers, depending on the composition of the soil and the load requirements of the building. In some embodiments, the concrete foundation slab 142 includes a quartz top finish and/or an epoxy coating to promote airtightness and long life. In this regard, cutting with a saw is minimized or avoided, depending on size of the concrete foundation slab 142 in each individual room.

In embodiments where the core is built from the finished concrete foundation slab 142 (such as shown in FIG. 5), the insulation layer 146 lays on top of the soil, then the vapor barrier, and then the concrete foundation slab 142 is poured over the top of the layers covering the entire surface area of the complete airtight building 100 (no individual slabs per room). Afterwards, the core 110 and insulating metal panels 120 are placed upon the finished concrete foundation slab 142. It will be appreciated that in the embodiments constructed as shown in FIG. 5, the concrete foundation slab 142 and the insulating metal panels 120 do not go down to foundation wall level. In this regard, the concrete foundation slab 142 and the U-channel brackets 152 for the insulating metal panels 120 may act as a thermal bridge, resulting in potential energy loss and the forming of condensation inside the rooms, among other issues.

Room Pressure Testing

When the construction, installation of specific airtight doors or other equipment, and sealing steps are completed in one or more airtight rooms, the rooms may be pressure tested to ensure airtightness. In some embodiments, the rooms are suitably pressure tested using a vacuum method where a light vacuum is pulled in the room. Once the desired amount of vacuum is obtained, the vacuum pump is turned off. If the room is airtight, the vacuum barometric pressure in the room will not change. If the vacuum pressure starts to decline, a leak may exist. At that point, the vacuum pump is turned on again and airflow is regulated to obtain a steady vacuum pressure. The amount of airflow needed to keep the pressure constant is measured during a period of time, to obtain a reading of total leak rate, from which a total leak surface rate can be calculated. The results of the total leak rate are recorded. In some embodiments, the acceptable total leak surface rate is less than 0.15 $cm^2$ per 100 $m^3$ of volume. In other embodiments, the acceptable total leak surface rate is less than 0.30 $cm^2$ per 100 $m^3$ of volume. The acceptable total leak surface rate promotes efficiency of the equipment used in the airtight building, allows quicker control of the room environment, and enables the room to reach pest control levels to kill both insects and larvae. Based on the results, the room is either passed within a certain leak tolerance, or additional air tightening work is performed before re-testing.

In some embodiments of the airtight building, a plant distribution throughout the cubic air space is performed using a vertical racking system (not shown) by placing the plants in soil in pots slightly on an angle in order for the plants to grow out on an angle. During growth, the plants will curve upwards towards the ceiling, thus forming a wall of plant canopy, which combined with another wall of canopy, will "sandwich" a row of low-heat emitting lights, thereby allowing the plants to reside within 1 foot from the lights on either side. The plant distribution is repeated several times in the same room from floor to ceiling, occupying and optimizing the cubic air space, and allowing the plants to be uniformly spread out in the airspace to receive a consistent and uniform air distribution during the pest control treatment.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A building having a degree of airtightness, comprising:
- a concrete foundation slab;
- a first column and a second column extending vertically away from an upper surface of the concrete foundation slab;
- a guard portion coupled to a laterally outward facing surface of the first and second columns and extending horizontally therebetween;
- a plurality of insulated metal panels coupled to a laterally outward facing surface of the guard portion such that the plurality of insulated metal panels are spaced apart from the first and second columns, a portion of the plurality of insulated metal panels positioned adjacent to the concrete foundation slab, the plurality of insulated metal panels forming a wall of the building; and
- a seal disposed at the interface of the plurality of insulated metal panels and the guard portion.

2. The building of claim 1, further comprising a beam extending between the distal ends of the first and second columns and a plurality of insulated metal panels coupled to the beam forming a roof of the building.

3. The building of claim 2, wherein the plurality of insulated metal panels forming the wall and the plurality of insulated metal panels forming the roof are coupled with an L-shaped bracket at the intersection of the wall and the roof.

4. The building of claim 1, wherein the guard portion is configured to deflect impacts against the wall from the interior of the building away from the plurality of insulated metal panels.

5. The building of claim 1, wherein the seal comprises a poly-urethane caulking.

6. The building of claim 1, wherein the plurality of insulated metal panels forming the wall are coupled to the concrete foundation slab using a U-channel bracket.

7. An atmospherically controlled building, comprising:
- a concrete foundation wall forming a perimeter of the building and other support areas internal to the perimeter;
- a concrete foundation slab positioned above an upper surface of the concrete foundation wall;
- a plurality of columns extending vertically away from an upper surface of the concrete foundation slab;
- a guard portion coupled to a laterally outward facing surface of the plurality of columns and extending horizontally therebetween;
- a plurality of insulated metal panels coupled to a laterally outward facing surface of the guard portion such that the plurality of insulated metal panels are spaced apart from the plurality of columns, a portion of the plurality of insulated metal panels positioned adjacent to the concrete foundation slab, wherein the plurality of insulated metal panels form a perimeter wall of the building; and
- a seal disposed at the interface of the plurality of insulated metal panels and the guard portion, and disposed at the interface of the plurality of insulated metal panels and the concrete foundation slab.

8. The building of claim 7, further comprising a plurality of beams extending between the distal ends of the columns, a plurality of trusses spanning the perimeter of the building, and a plurality of insulated metal panels coupled to the plurality of beams and trusses and forming a roof of the building.

9. The building of claim 8, wherein the plurality of insulated metal panels forming the wall and the plurality of insulated metal panels forming the roof are coupled with an L-shaped bracket at the intersection of the wall and the roof.

10. The building of claim 7, wherein the guard portion is configured to deflect impacts against the perimeter wall from the interior of the building away from the plurality of insulated metal panels.

11. The building of claim 7, wherein the plurality of insulated metal panels forming the wall are coupled to the concrete foundation wall using a U-channel bracket.

12. A method of constructing a building with a degree of airtightness, the method comprising:
- pouring a concrete foundation wall to form a building perimeter and other support areas internal to the perimeter;
- anchoring a plurality of columns to the concrete foundation wall such that the plurality of columns extend vertically from the concrete foundation wall around the building perimeter;
- coupling a plurality of insulated metal panels to the columns to form a perimeter wall of the building;
- pouring a concrete foundation slab to extend between the plurality of columns;
- coupling a plurality of beams to the distal ends of the plurality of columns, the beams arranged horizontally;

coupling a plurality of insulated metal panels to the beams to form a roof of the building; and applying a seal at the interface of the plurality of insulated metal panels forming the perimeter wall and the columns, the interface of the plurality of insulated metal panels forming the perimeter wall and the concrete foundation slab, the interface of the plurality of insulated metal panels forming the roof and the plurality of beams, and the interface of the plurality of insulated metal panels forming the perimeter wall and the plurality of insulated metal panels forming the roof.

13. The method of claim 12, wherein the plurality of insulated metal panels forming the perimeter wall and the plurality of insulated metal panels forming the roof are coupled with an L-shaped bracket at the intersection of the perimeter wall and the roof.

14. The method of claim 12, further comprising coupling a guard portion extending horizontally between the plurality of columns, the guard portion configured to deflect impacts away from the plurality of insulated metal panels forming the perimeter wall.

15. The method of claim 12, wherein the plurality of insulated metal panels forming the perimeter wall are coupled to the concrete foundation wall using a U-channel bracket.

16. The method of claim 12, further comprising applying a primer, paint, and a fleece to the plurality of insulated metal panels.

17. An atmospherically controlled building, comprising:

a concrete foundation wall forming a perimeter of the building and other support areas internal to the perimeter;

a plurality of columns extending vertically from the concrete foundation wall;

a plurality of insulated metal panels coupled to the columns and extending from the concrete foundation wall, the plurality of insulated metal panels forming a perimeter wall of the building;

a concrete foundation slab extending between the plurality of columns;

a seal disposed at the interface of the plurality of insulated metal panels and the columns, and the interface of the plurality of insulated metal panels and the concrete foundation slab;

a plurality of beams extending between the distal ends of the columns;

a plurality of trusses spanning the perimeter of the building; and a plurality of insulated metal panels coupled to the plurality of beams and trusses and forming a roof of the building.

18. The building of claim 17, wherein the plurality of insulated metal panels forming the wall and the plurality of insulated metal panels forming the roof are coupled with an L-shaped bracket at the intersection of the wall and the roof.

19. The building of claim 17, further comprising a guard portion extending horizontally between the first and second columns and configured to deflect impacts away from the plurality of insulated metal panels.

20. The building of claim 17, wherein the seal comprises a poly-urethane caulking.

21. The building of claim 17, wherein the plurality of insulated metal panels forming the wall are coupled to the exterior of the plurality of columns.

22. The building of claim 17, wherein the plurality of insulated metal panels forming the wall are coupled to the concrete foundation wall using a U-channel bracket.

* * * * *